United States Patent [19]

Salusinszky

[11] 4,250,021

[45] Feb. 10, 1981

[54] TREATING USED HYDROCARBON LUBRICATING OILS

[76] Inventor: Andor L. Salusinszky, 27 Bertram St., Burwood, Victoria, Australia

[21] Appl. No.: 70,713

[22] Filed: Aug. 29, 1979

[30] Foreign Application Priority Data

Sep. 28, 1979 [AU] Australia ..... PD6150

[51] Int. Cl.[3] ..... C10M 11/00

[52] U.S. Cl. ..... 208/181; 208/179; 208/251 R

[58] Field of Search ..... 208/179–181

[56] References Cited

U.S. PATENT DOCUMENTS

| | | | |
|---|---|---|---|
| 3,282,827 | 11/1966 | Grysiak, Jr. | 208/180 |
| 3,682,990 | 9/1972 | Schoen et al. | 260/410.5 |
| 3,879,282 | 4/1975 | Johnson | 208/179 |
| 3,930,988 | 1/1976 | Johnson | 208/179 |
| 3,985,642 | 10/1976 | Friel et al. | 208/180 |
| 4,105,542 | 8/1978 | Fainman | 208/180 |

FOREIGN PATENT DOCUMENTS

| | | | |
|---|---|---|---|
| 50-22980 | 8/1975 | Japan | 208/181 |
| 52-6726 | 2/1977 | Japan | 208/180 |
| 7805206 | 11/1978 | Netherlands | 208/179 |
| 1006888 | 10/1965 | United Kingdom . | |
| 250049 | 11/1967 | U.S.S.R. | 208/181 |

*Primary Examiner*—Delbert E. Gantz
*Assistant Examiner*—Gary P. Straub
*Attorney, Agent, or Firm*—Bernard & Brown

[57] ABSTRACT

Process for removing metal(s) and water from used hydrocarbon lubricating oil characterized in that the said used oil is treated with an aqueous solution containing a surfactant and anions which form an insoluble salt or insoluble salts with at least one metal present in the said used oil followed by separation of an oil layer of reduced metal and water content.

The oil so treated is suitable for refinery feedstock, and also as fuel oil or as blendstock for other hydrocarbon products, or as rerefining feedstock.

10 Claims, No Drawings

TREATING USED HYDROCARBON LUBRICATING OILS

This invention relates to a treating process for used hydrocarbon lubricating oils.

The base oils for hydrocarbon lubricating oils are produced in refineries from vacuum distillates and from oily components extracted from the residue of vacuum distillation. These streams are produced in several treating steps, in modern plants usually comprising solvent extraction, solvent dewaxing and hydrogen treatment. To be able to meet the demands of modern engines, particularly those of internal combustion engines, various additives are incorporated in the base oil. Such additives include, for example, antioxidants, pour point depressants, viscosity index improvers, detergents, dispersants, and other additives.

In use lubricating oils are not consumed in the usual sense and, except for some loss, are recovered as used oils. In the case of motor oils, usually more than 60% are recovered when the oil is changed. This oil change is necessary because in use the oil is diluted with unburned fuel (usually about 5% by the time of oil change), and becomes contaminated, inter alia, by combustion products which are kept dispersed by the dispersants, and by lead from the fuel, typically 0.1–0.8%, usually in the form of oxide dispersed with the combustion products. It also has a high ash content, typically in the range 1.5–2.5%, due to metals (mainly Ca, Ba, and Zn) which were added to the base oil as components of additives.

Used lubricating oil also contains water. The water content of freshly drained used lubricating oil is usually less than 0.5% but often increases during collection. This water is also dispersed in the used lubricating oil and settles, if at all, very slowly.

Lubricating oil production represents about 1.5% of the crude oil processed in the oil refineries. Since a substanatial part of the lubricating oil produced is used for automotive purposes and less than 40% of automotive oil is lost in use, it will be appreciated that substantial quantities of used hydrocarbon lubricating oils are available for disposal.

Much effort has been expended in attempts to recycle this waste oil by rerefining it to lubricating oil. However, rerefining is seldom economic since the relatively small size of the rerefining plants make it difficult to complete with the lubricating oil refineries working at a much larger scale. In recent years this problem has been aggravated by technical difficulties, since modern additives, mainly the dispersants, render the conventional rerefining methods, based mainly on treatment with concentrated sulphuric acid, uneconomical. In particular the dispersants prevent the efficient separation of the acid sludge, thus increasing operating costs and losses.

Many processes were proposed for rerefining used hydrocarbon lubricating oil (see example United States Bureau of Mines Reports R1 7884 and 7925, (1974) Whisman et al "Waste Lubricating Oil Research") but to date no process has been established which would be competitive under normal economic conditions which new lubricating oil produced on a much larger scale.

Used hydrocarbon lubricating oil may also be used as fuel oil. However, the lead therein presents an environmental pollution problem, and the other metals, which increase ash production, adversely affect heat thransfer. Although water content, and other fuel contaminants causing low flash point, are drawbacks which can be corrected, removal of lead and other metals from used hydrocarbon lubricating oil intended for use as fuel oil presents a major problem, particularly if the economics of the process are considered.

In this connection, U.S. Pat. No. 3,923,643 proposes to remove lead and other suspended solids by heating used oil at about 500° to 700° F. after flashing off the water and light hydrocarbon material. This method precipitates the contaminants as a sludge, causing substantial treating losses. U.S. Pat. No. 3,763,036 uses methylethyl ketone after dehydration to precipitate the same contaminants. This process involves several steps and a high cost solvent.

It has been proposed to precipitate the metals, including lead, buy using certain salts in aqueous solution. A serious difficulty encountered in these treatments is that rather stable emulsions are formed as interface. In an attempt to overcome the formation of the emulsion, high pressure and temperature may be applied (for instance U.S. Pat. No. 3,879,282 using ammonium phosphate at 90 to about 350 psig and 325° to 425° F., and U.S. Pat. No. 3,930,988 using ammonium sulfate and/or ammonium hydrogen sulfate at up to 750 psig and up to 500° F.). Another proposal to avoid the formation of an emulsion is to dilute the used hydrocarbon oil prior to treatment. U.S. Pat. No. 3,819,508 employs for dilution a light hydrocarbon liquid with a boiling range of 100° F.–500° F., while U.S. Pat. No. 3,835,035 in addition also admixes a water miscible alcohol. These processes are generally too expensive to be able to compete in the low priced fuel oil market and in themselves are not efficient enough to produce an acceptable rerefined lubricating oil.

The intended products of the above mentioned prior art processes have to compete in an established market both for fuel oil and for lubricating oil. A major factor in the unacceptably high cost of those processes is that operations are carried out on a relatively small scale compared with the production of new lubricating and fuel oils.

It is the object of the present invention to avoid this drawback by developing a simple process for the removal of metals and water from waste hydrocarbon lubricating oil. The treated oil could then be used as feedstock to a vacuum tower to produce in the refinery feedstock to a lube refinery or to a catalytic cracker. This way of recycling would avoid any marketing problems. Of course, the treated oil could also be used directly as fuel oil or as blendstock for other hydrocarbon products, or as feedstock at a rerefining plant where it would reduce rerefining loses.

The present invention accordingly provides a process by which lubricating oils may be effectively recycled. For this application the water and metals content of used hydrocarbon lubricating oil needs to be substantially reduced, preferably by a continuous process involving relatively simple equipment and low chemical consumption.

The treating process of the invention accordingly provides for the removal of water and metals from used hydrocarbon lubricating oils. The oil so treated is suitable for refinery feedstock, and also as fuel oil or as blendstock for other hydrocarbon products, or as rerefining feedstock.

The invention utilises the known reaction of the metals with anions which form water insoluble salts therewith. We have found that by adding surfactant to the system, formation of the interface emulsion is substantially avoided and unexpectedly efficient separation of the oil phase from the aqueous phase is accomplished.

The invention accordingly provides a process in which used hydrocarbon lubricating oil is contacted with an aqueous solution containing one or more anions, such as for example oxalate, phosphate, sulfate, chromate, etc., which form water insoluble salt (s) with the metal (s) to be removed from the used hydrocarbon lubricating oil, and a surfactant, which minimises the formation of an emulsion. After such treatment and separation by conventional means we have found that an oily layer is obtained which is practically dry and has a low metal content.

In the treating process in accordance with the invention the cation of the aqueous solution is exchanged with the metals of the metal-containing components of the used hydrocarbon lubricating oil. In order to avoid the entry of another metal into the treated oil, which among others would increase its ash content, the cation of the aqueous solution is preferably ashless, for example hydrogen, ammonium, hydrazine, hydroxylamine, and/or phosphorus. Accordingly, we have found that, for instance, oxalic acid is a suitable reagent. Dilute sulfuric acid is also suitable. We have also found it practical to use a solution containing both ammonium and hydrogen cations, that is an ammonium salt with the anions mentioned heretofore and an acid of the anions mentioned heretofore. The quantity and the concentration of the aqueous solution is of little importance as long as excess anion (s) are still present in the aqueous layer after treatment.

The anion (s) in the aqueous solution form salts with the metals in the oil, the equilibrium of this reaction being dependent on the solubility of the metal salt in the aqueous solution. Since solubility of the various metal salts is different, it is expedient in appropriate circumstances to use a combination of anions. In one embodiment of the process in accordance with this aspect of the invention, sulfate anion is used in a first treatment step. After separation of the aqueous layer from the first step, the separated aqueous layer is treated in a second step with oxalate anion to further precipitate those metals whose oxalate salt is relatively insoluble but whose sulfate salt has a relatively high solubility like calcium and zinc. Of course the two ions sulphate and oxalate can be also combined in one treating solution. Other variations of this aspect of the invention, depending upon the relative solubilities, will be apparent to persons skilled in the art and are within the scope of this invention.

The use of surfactants as coupling agent is described in Canadian Pat. No. 1,027,502 in conjunction with oxidising agents such as peroxides, persulfates etc., which oxidise the suspending components and thus make settling possible. Naturally oxidation, beside being an expensive process, increases treating losses. Also, as described in the said Canadian patent previous dehydration is preferable for efficient removal of contaminants. This is quite different from the process of the present invention, in which we have found that surfactants on their own and without preliminary dehydration can effect separation of used hydrocarbon lubricating oil from water and/or from an aqueous treating solution.

It is particularly remarkable that, in the practice of the present invention, the separated oil layer is found to be practically dry, usually below 0.5% by weight and commonly containing less than 0.1% water.

Both ionic and non-ionic surfactants can be used in the process in accordance with the invention. Although we do not wish to be limited by any theoretical or postulated mechanism for the observed beneficial effects, it is believed that they may solubilise the detergent and dispersant additives in the used hydrocarbon lubricating oil, in this way the effect of these additives is reduced to such an extent that no or hardly any emulsion is formed at the interface. Among the surfactants ethoxylated nonyl alcohols or phenols were found to be most suitable. A concentration of 0.1 to 2% by volume referred to the oil to be treated is usually sufficient and is preferred. The surfactant can be added to the system in various ways, for example direct to the oil on its own or diluted in water, prior to contact with the anion-containing aqueous solution, or it can be added to the aqueous salt solution and the mixture obtained in this way can be used as the treating agent.

The precipitation reaction is very fast even at moderate temperature. However, for ease of handling it is preferred to mix the two phases at a moderately elevated temperature, say around 80° C., to reduce the viscosity of the used oil. Separation is also accelerated by elevated temperature; 80° C. was found to be sufficient to achieve a phase separation at laboratory scale within a few hours.

The treating process can be carried out batchwise or continuously using conventional contacting and separating equipment. In most cases single contacting is sufficient, but multi-step contacting improves metal removal. Contacting may be followed by washing to remove traces of the aqueous treating solution. Used treating solution can be reused after the removal of the precipitate, containing predominantly lead salt, and after making up for the loss of surfactant and anions.

Treating loss in hydrocarbons is low. The practically dry and low metal content oily layer can be added to crude oil, to vacuum tower feed or to the distillates charged to the lubricating oil refinery, or to one of the units of the lubricating oil refinery, for instance a hydrogen treater. Another use of the treated oil is as feedstock to a catalytic cracker, particularly after vacuum distillation. The treated oil is also suitable as a low sulphur, low pour point fuel oil especially if light hydrocarbons are removed by stripping. After stripping, the oil can be used as a blendstock for various fuel oils, bunkers, light burning oils etc. or as feedstock to a re-refinery. Thus by the single treating process in accordance with the invention the used hydrocarbon lubricating oil is converted back with little loss into a hyrdrocarbon feedstock.

Preferred embodiments of the invention are illustrated in the following examples.

EXAMPLE 1

To 200 ml of mixed used hydrocarbon lubricating oil 30 ml of a treating solution was added, the treating solution containing 1 ml of ethoxylated nonyl alcohol, 1 g of concentrated (98%) sulfuric acid and 1.3 g of ammonium sulfate. The mixture was stirred at about 80° C. for half an hour and then allowed to settle at 80° C. Two layers formed, the lower aqueous layer containing a voluminous precipitate. After twenty-four hours separation was considered complete. The oily layer was clear, but dark and practically dry. Its lower part contained some dark sludge. The ash content of the sludge free oil was 0.07% by weight, lead content was less than 200 ppm. This compares with 1.4% ash and 1400 ppm Pb content of untreated oil.

EXAMPLE 2

To 8 liters of mixed used hydrocarbon lubricating oil heated to 80° C. 1 liter of a treating solution was added, the solution contained ammonium hydrosulfate, 40 g
diammonium phospate, 40 g
surfactant, 40 g After stirring for 5 minutes at atmospheric pressure the mixture was fed to a small industrial centrifuge.

The water free oil still contained dispersed solid particles which, however, readily settled. The dark but in thin layer transparent oil had the following properties:

Viscosity cSt at 100° C., 14.2
Acid number, mg/liter, 1.2
Ash, % by weight, 0.06
Metals, ppm,
lead, 80
zinc, 2
Iron, 10
nickel, 1
copper, 7
chromium, 12
vanadium less than, 1

The bowl of the centrifuge contained a pasty sludge with a composition (on a dry basis):

Lead, %, 30.3
Zinc, 4.1
Calcium, 3.7

EXAMPLE 3

200 ml of used lubricating oil was treated first with 50 milliliters of an aqueous solution containing 0.5 milliliters of a surfactant and 2 grams of oxalic acid. After separation by settling the oily layer was treated with 50 milliliters of an aqueous solution containing 0.5 milliliters of a surfactant and 1 gramm of diammonium hydro-phosphate. The ash content of the oil was reduced from 1.6% by weight to 0.05% by weight.

EXAMPLE 4

To 50 milliliters of the separated aqueous layer from Example 2 0.5 milliliters of a surfactant and 0.5 grams of diammonium hydro-phosphate were added and 200 ml of used lubricating oil was treated as in Example 1. The ash content of the separated oil was 0.06% by weight indicating that the aqueous effluent, after making up for the consumed chemicals, can be reused.

I claim:

1. Process for removing water and at least one metal from used hydrocarbon lubricating oil comprising treating said used oil with an aqueous solution containing a surfactant and anions which form an insoluble salt with at least one metal present in the said used oil, said anions being selected from the group consisting of;

(a) oxalate,
(b) chromate, and
(c) at least two of oxalate, chromate, phosphate and sulfate, and separating an oil layer of reduced metal and water content from the aqueous solution.

2. Process according to claim 1 in which the said used oil is treated with the said aqueous solution at atmospheric pressure and at a temperature between 55° and 95° C.

3. Process according to claim 1 or claim 2 in which the anions in the aqueous solution are present with cations which do not form ash.

4. Process according to claim 3 in which the cations are selected from one or more of the group consisting of hydrogen, ammonium, hydrazine, hydroxylamine, and phosphorus.

5. Process according to claim 1 in which a combination of anions forming insoluble salts with metals contained in the used lubricating oil is used in one treatment or in subsequent treatments.

6. Process according to claim 1 in which the anions are oxalate and at least one of phosphate and sulfate.

7. Process according to claim 1 in which the surfactant is an ethoxylated alcohol or phenol.

8. Process according to claim 7 in which the surfactant is used in the proportion of 0.1 to 2%, of the volume of the treated oil.

9. Process according to claim 2 in which said used oil is treated at a temperature between 65° and 80° C.

10. Process according to claim 7 in which the surfactant is used in the proportion of 0.3 to 1% of the volume of the treated oil.

* * * * *